US007555972B1

(12) United States Patent
Chen

(10) Patent No.: US 7,555,972 B1
(45) Date of Patent: Jul. 7, 2009

(54) SAFE TOOL ASSEMBLY

(76) Inventor: Shu-Hui Chen, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 12/019,646

(22) Filed: Jan. 25, 2008

(51) Int. Cl.
*B25B 23/00* (2006.01)

(52) U.S. Cl. ..... 81/440; 81/177.4; 81/177.6; 81/489; 81/492

(58) Field of Classification Search ..... 81/177.4, 81/177.6, 440, 489, 492
See application file for complete search history.

(56) References Cited

U.S. PATENT DOCUMENTS 4,269,311 A * 5/1981 Rich ..... 206/234
6,257,947 B1 * 7/2001 Glaser ..... 446/73
6,637,061 B1 * 10/2003 Spracklin et al. ..... 7/138

* cited by examiner

*Primary Examiner*—Joseph J Hail, III
*Assistant Examiner*—Shantese McDonald

(57) ABSTRACT

A safe tool assembly comprises an assembly part including a body, on the two ends of which is disposed at least one connecting tab having tools attached thereon, provided at least two through apertures at the side surfaces thereof individually and each having two small-diametered insertion bores fixed on the two sides thereof, wherein the two insertion bores are opposite to each other, and between each of the insertion bores and each of the through apertures is provided a stopping rim; two protective covers assembled to the two sides of the assembly part and including at least one pillar affixed therein, at the front end of which is mounted a locking tab having recesses secured therein, and including two gaps arranged on the two sidewalls thereof, hence by engaging the locking tabs with the stopping rims, the protective covers may be opened and stored stably, operating the desired tool safely.

3 Claims, 5 Drawing Sheets

SAFE TOOL ASSEMBLY

BACKGROUND OF THE INVENTION

1. Field of the Invention

The present invention relates to a safe tool assembly and more particularly to two protective covers of the safe tool assembly that may be opened and stored stably, thereby operating the desired tool safely.

2. Description of the Prior Arts

As shown in FIG. 1, a portable tool assembly comprises two opposite grips 10 including a shaft member 11 disposed at each side thereof and having tools 12 axially mounted thereon. Each of the tools 12 includes a fitting hole 120 formed on one end thereof by which the shaft member 10 is connected with the tool 12, thus enabling to use or store the desired tool 12. However, such a conventional tool assemble may not be positioned while in use, causing danger.

The present invention has arisen to mitigate and/or obviate the afore-described disadvantages.

SUMMARY OF THE INVENTION

The primary object of the present invention is to provide a safe tool assembly, two protective covers of which may be opened and stored stably, thereby operating the desired tool safely.

Another object of the present invention is to provide a safe tool assembly, the tool of which may be stored quickly.

In accordance with one aspect of the present invention, there is provided a safe tool assembly comprising an assembly part including a body, on each of the extending portions at the front and rear ends of which is disposed a connecting tab having a plurality of tools attached thereon, provided abutting surfaces at the front and rear sides thereof respectively for the regular arrangement of the tools, and including at least two through apertures formed at the side surfaces thereof individually and each having two small-diametered insertion bores fixed on two sides thereof individually, wherein the two insertion bores are opposite to each other, for example, one insertion bore of the through aperture is attached on the left side of the body, yet another insertion bore of the through aperture is attached on the right side of the body, and between each of the insertion bores and each of the through apertures is provided a stopping rim;

two protective covers assembled to two sides of the assembly part and each being constructed in the form of a semicircular housing, and including at least one pillar affixed therein, at the front end of which is mounted a locking tab having recesses secured thereon, and including two gaps arranged on the two sidewalls thereof respectively.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
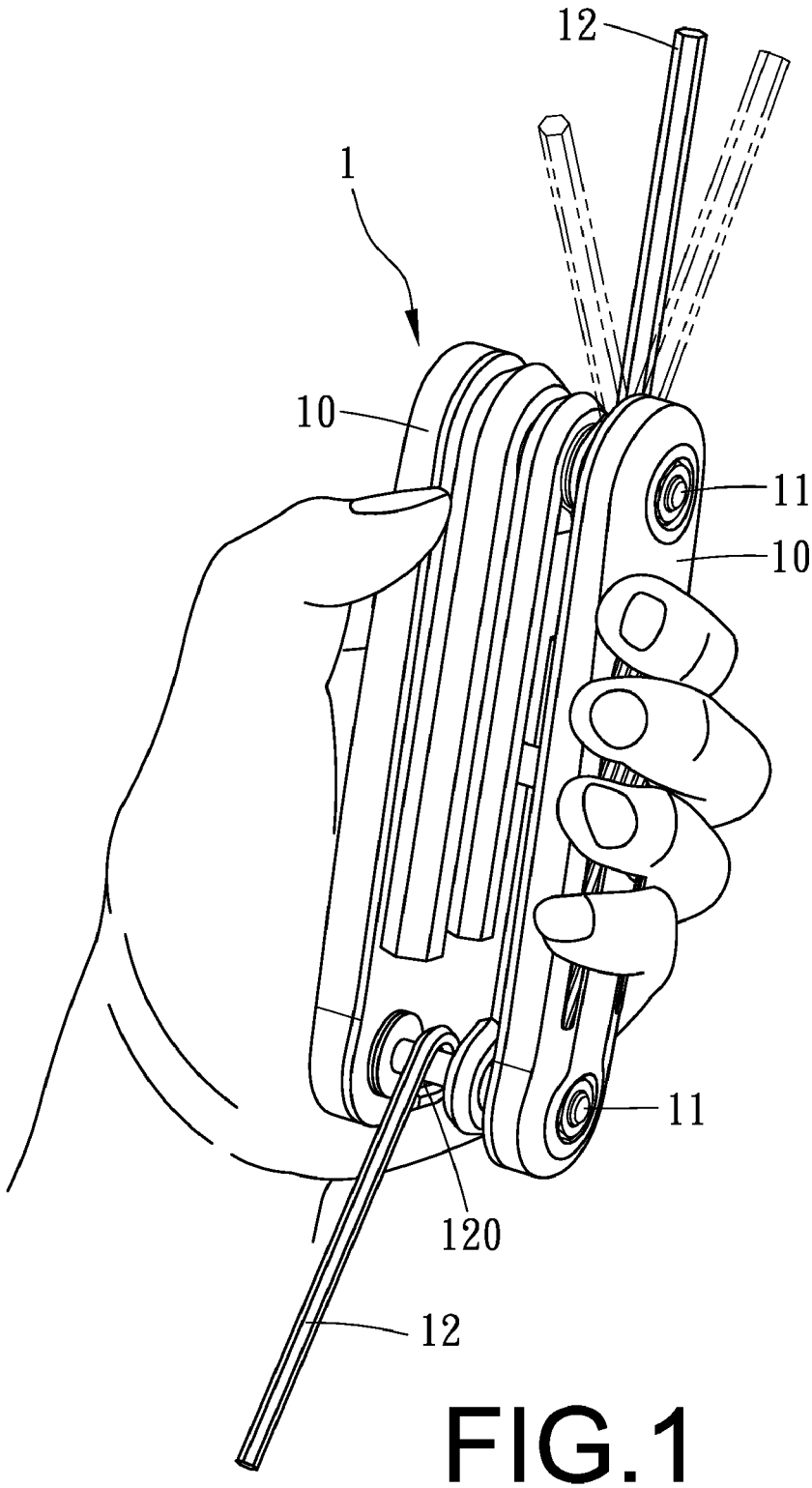
FIG.1 (PRIOR ART)
FIG. 1 is a perspective view illustrating the operation of a conventional tool assembly.
Figure 2:
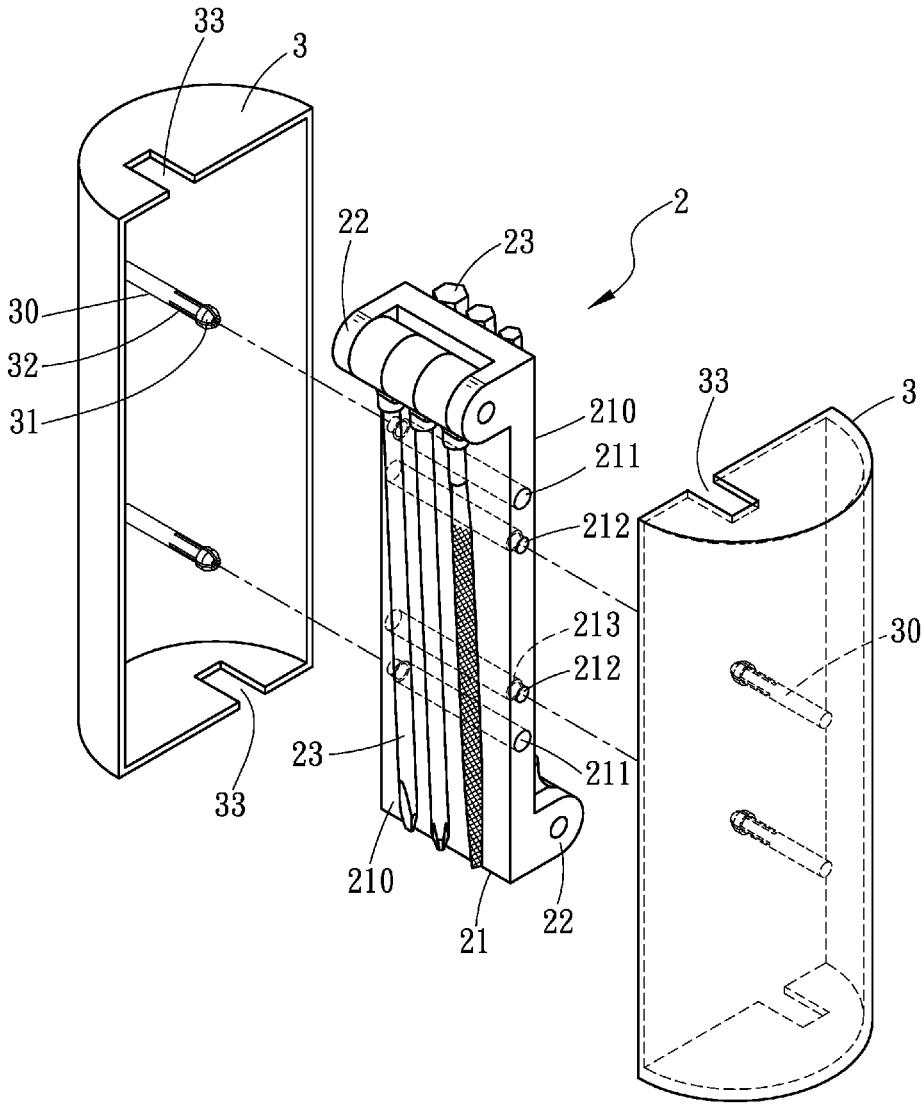
FIG. 2 is a perspective view illustrating the exploded components of a safe tool assembly accordingly to the present invention.
Figure 3:
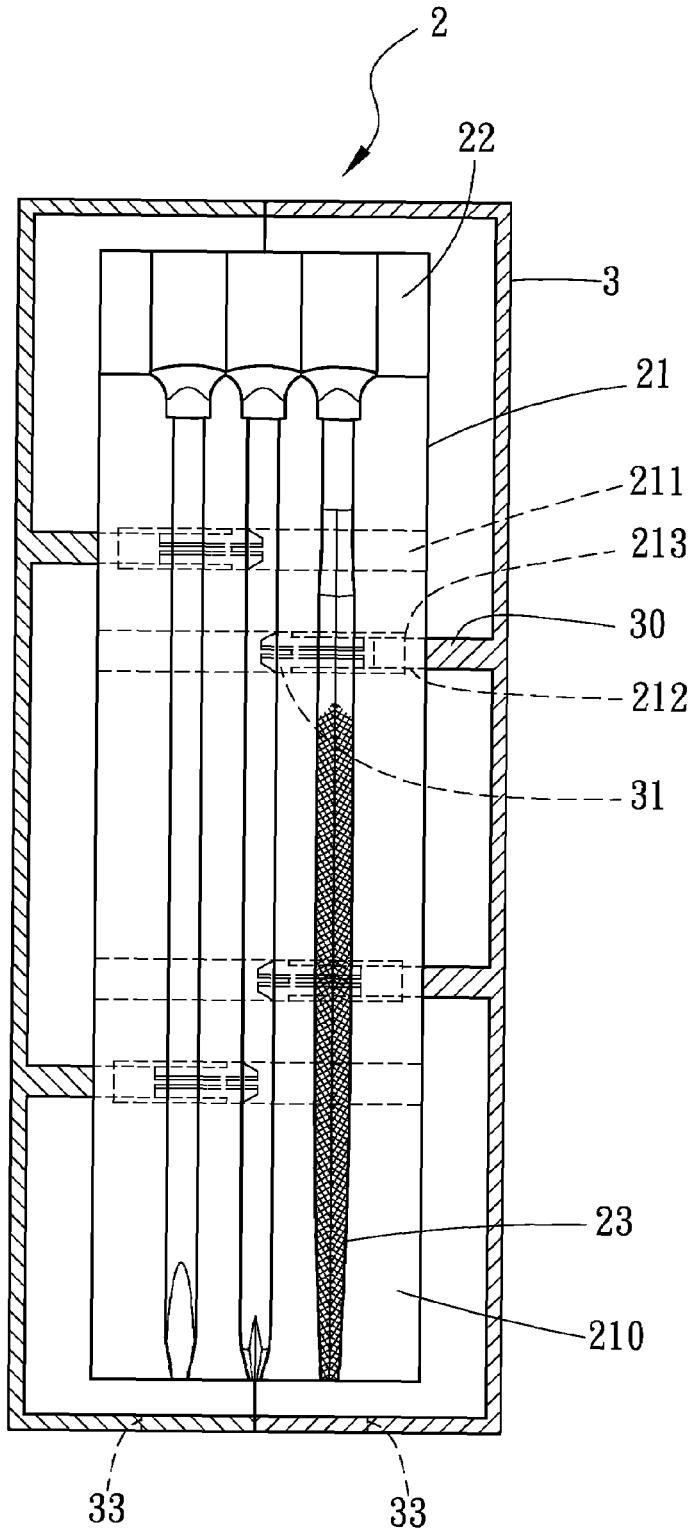
FIG. 3 is a cross sectional view illustrating the assembly of the safe tool assembly accordingly to the present invention.
Figure 4:
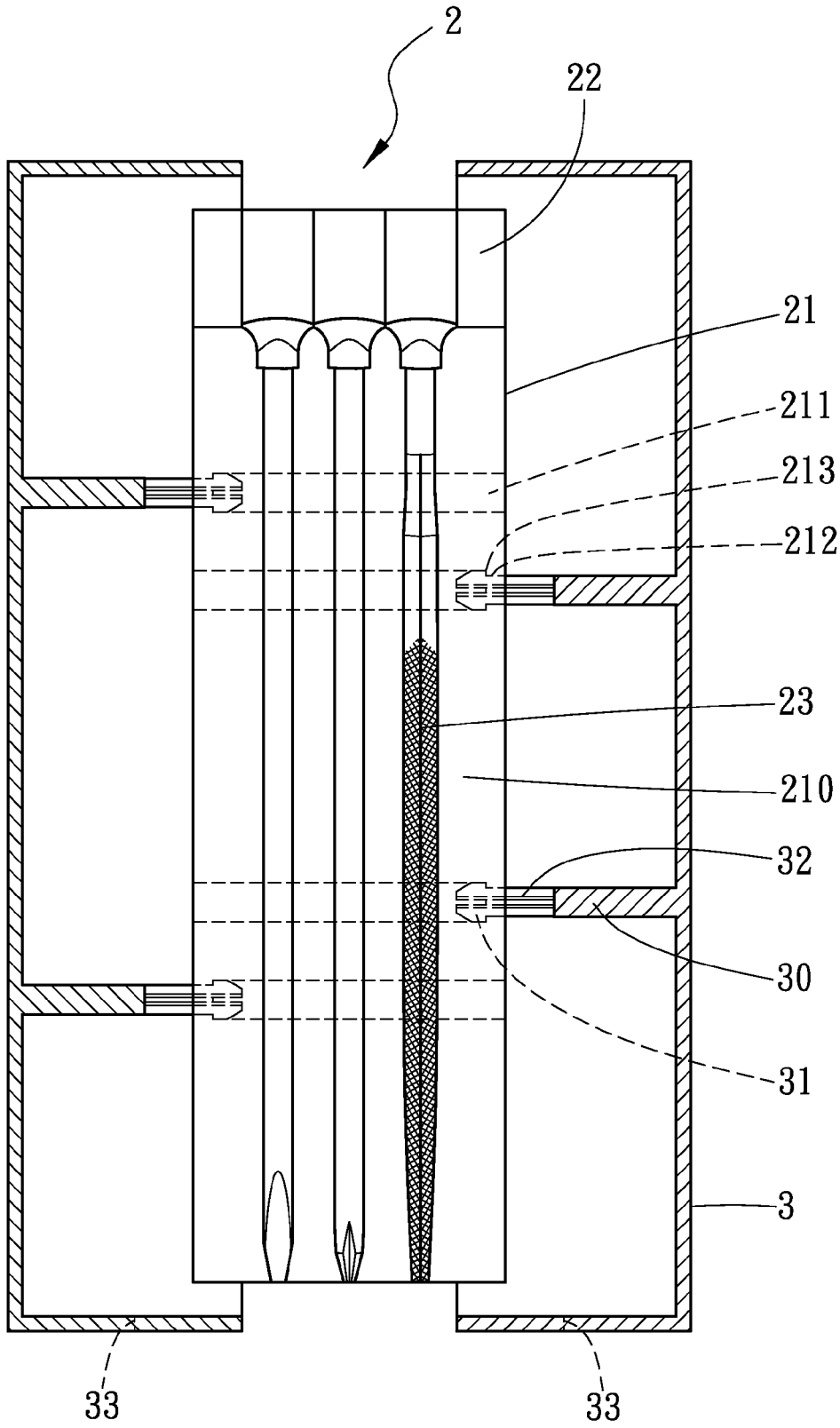
FIG. 4 is a cross sectional view illustrating two protective covers being pulled outward.

Referring to FIGS. 2-4, a safe tool assembly in accordance with the present invention comprises an assembly part 2 including a body 21, on each of the extending portions at the front and rear ends of which is disposed a connecting tab 22 having a plurality of tools 23, such as drivers, drills, files, etc. attached thereon, provided abutting surfaces 210 at the front and rear sides thereof respectively for the regular arrangement of the tools 23, and including at least two through apertures 211 formed at the side surfaces thereof individually and each having two small-diametered insertion bores 212 fixed on the two sides thereof individually, wherein the two insertion bores 212 are opposite to each other, for example, one insertion bore 212 of the through aperture 211 is attached on the left side of the body 21, yet another insertion bore 212 of the through aperture 211 is attached on the right side of the body 21, and between each of the insertion bores 212 and each of the through apertures 211 is provided a stopping rim 213;

two protective covers 3 assembled to the two sides of the assembly part 2 and each being constructed in the form of a semicircular housing, and including at least one pillar 30 affixed therein, at the front end of which is mounted a locking tab 31 having recesses 32 secured thereon, and including two gaps 33 arranged on the two sidewalls thereof respectively.

As shown in FIGS. 2-4, in assembly, the tools 23 are axially disposed onto the connecting tabs 22 of the two ends of the body 21 so as to be pivotally rotated, and the pillars 30 of the two protective covers 3 are aligned with the through apertures 211 on the side surfaces of the assembly part 2 for being further inserted into the through apertures 211. During the locking tabs 31 pass through the insertion bores 212, their outer diameters become smaller by way of the recesses 32 thereof, and then after the locking tabs 31 are further inserted into the through apertures 211, they become expandable so as to be engaged with the stopping rims 213, tightly engaging the protective covers 3 with the body 21 together.

Figure 5:
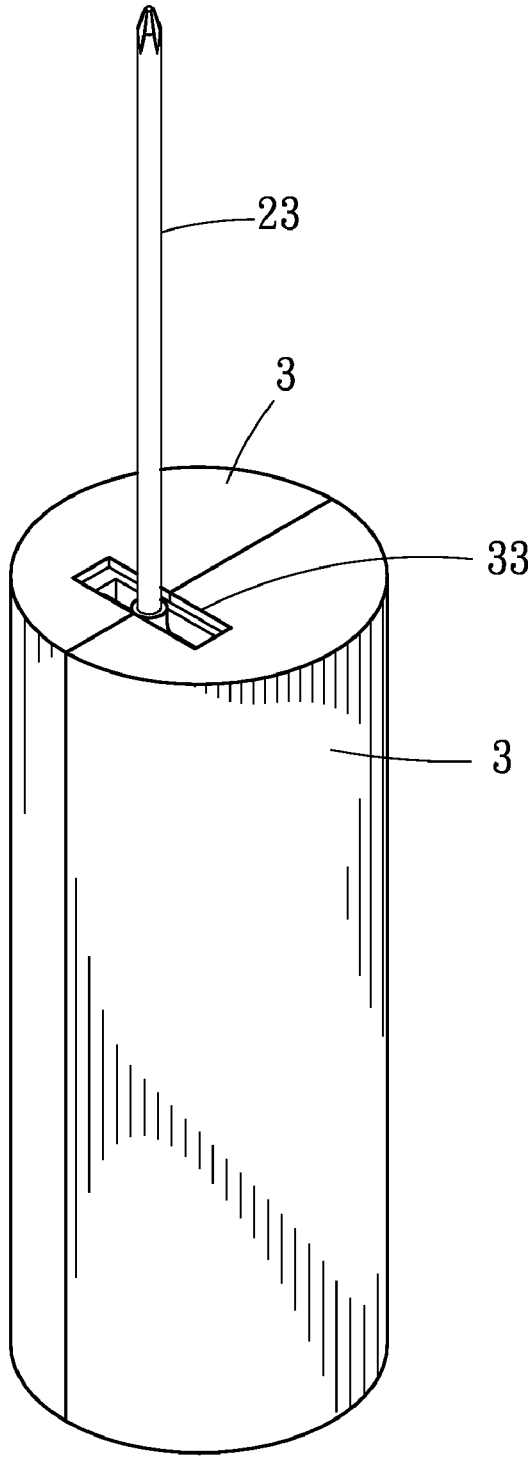
FIG. 5 is a perspective view illustrating the operation of the safe tool assembly accordingly to the present invention.

As illustrated in FIGS. 3-5, in operation, the two protective covers 3 are pulled outward, and one desired tool 23 is rotated upward, then the protective covers 3 are covered together so that the desired tool 23 may extend out of the gaps 33 of the protective covers 3 for being further positioned.

It can be clearly seen from the preceding accounts on the features of the present invention that the safe tool assembly of the present invention has the following advantages:

1. By engaging the locking tabs 31 of the protective covers 3 with the stopping rims 213 of the through apertures 211, the protective covers 3 may be opened and stored stably, thereby operating the desired tool safely.

2. In the storage, the two protective covers 3 are pulled outward to rotate the desired tool 23 inward, matingly abutting against the abutting surface 210 of the body 21, and the two protective covers 213 are further covered together, thus quickly storing the desired tool 23.

The invention is not limited to the above embodiment but various modifications thereof may be made. It will be understood by those skilled in the art that various changes in form and detail may be made without departing from the scope and spirit of the present invention.

What is claimed is:

1. A safe tool assembly comprising:

an assembly part including a body; each of two ends of the body being disposed with two connecting tabs for attaching a plurality of tools thereon, the body having at least two through apertures penetrating through two opposite sides thereof and each through aperture having only one small-diametered insertion bore at one end thereof; wherein said two respective insertion bores of the at least two through apertures are arranged at the two opposite sides of the body; and a stopping rim is formed at an opening of each insertion bore at an interior of the body; and two protective covers assembled to the two opposite sides of the body and each protecting cover including at least one pillar affixed therein, at a front end of each pillar being mounted with a locking tab having recesses secured therein.

2. The safe tool assembly as claimed in claim 1, wherein on an extending portion of each end of said assembly part is disposed a connecting tab.

3. The safe tool assembly as claimed in claim 1, wherein at a front and a rear side of said body of said assembly part are provided abutting surfaces respectively.

* * * * *